United States Patent [19]

Morgenstern

[11] 4,454,671

[45] Jun. 19, 1984

[54] TIMETABLE DISPLAY

[75] Inventor: Johannes Morgenstern, Coral Gables, Fla.

[73] Assignee: Trans-Ad Corporation, Coral Gables, Fla.

[21] Appl. No.: 396,117

[22] Filed: Jul. 7, 1982

[51] Int. Cl.[3] ..... G09F 15/00

[52] U.S. Cl. ..... 40/607; 40/19; 40/10 D

[58] Field of Search ..... 40/607, 10, 19, 10 D, 40/333, 10 R

[56] References Cited

U.S. PATENT DOCUMENTS

| | | | |
|---|---|---|---|
| 3,713,237 | 1/1973 | Thomson et al. | 40/607 |
| 3,928,930 | 12/1975 | Attwood | 40/607 |
| 3,986,284 | 10/1976 | Plantinga | 40/607 |
| 4,019,269 | 4/1977 | Vix | 40/306 |
| 4,164,084 | 8/1979 | Crockett | 40/607 |
| 4,300,299 | 11/1981 | Batky et al. | 40/607 |
| 4,329,801 | 5/1982 | Clausen | 40/607 |

FOREIGN PATENT DOCUMENTS

| | | | |
|---|---|---|---|
| 2905546 | 8/1980 | Fed. Rep. of Germany | 40/603 |

*Primary Examiner*—Gene Mancene
*Assistant Examiner*—Wenceslao J. Contreras
*Attorney, Agent, or Firm*—Jackson, Jones & Price

[57] ABSTRACT

A cylindrical display for bus scheduling and the like including a number of semi-cylindrical plastic sections and suitable retaining means for securing the various sections into a unified whole.

4 Claims, 9 Drawing Figures

FIG. 1
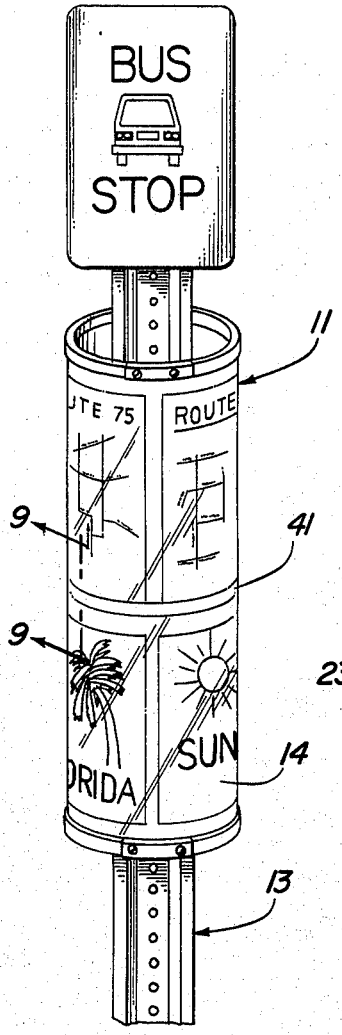
FIG. 2
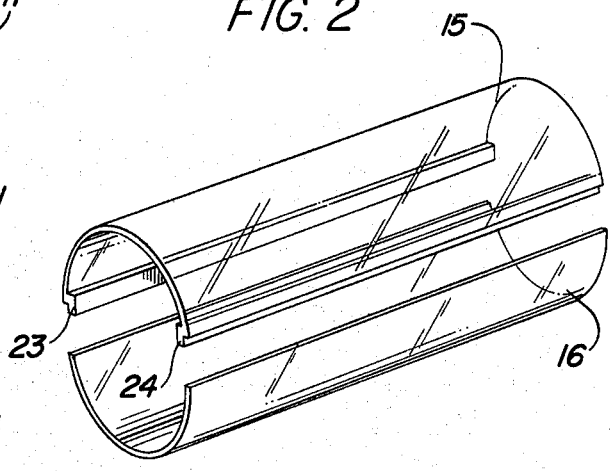
FIG. 3
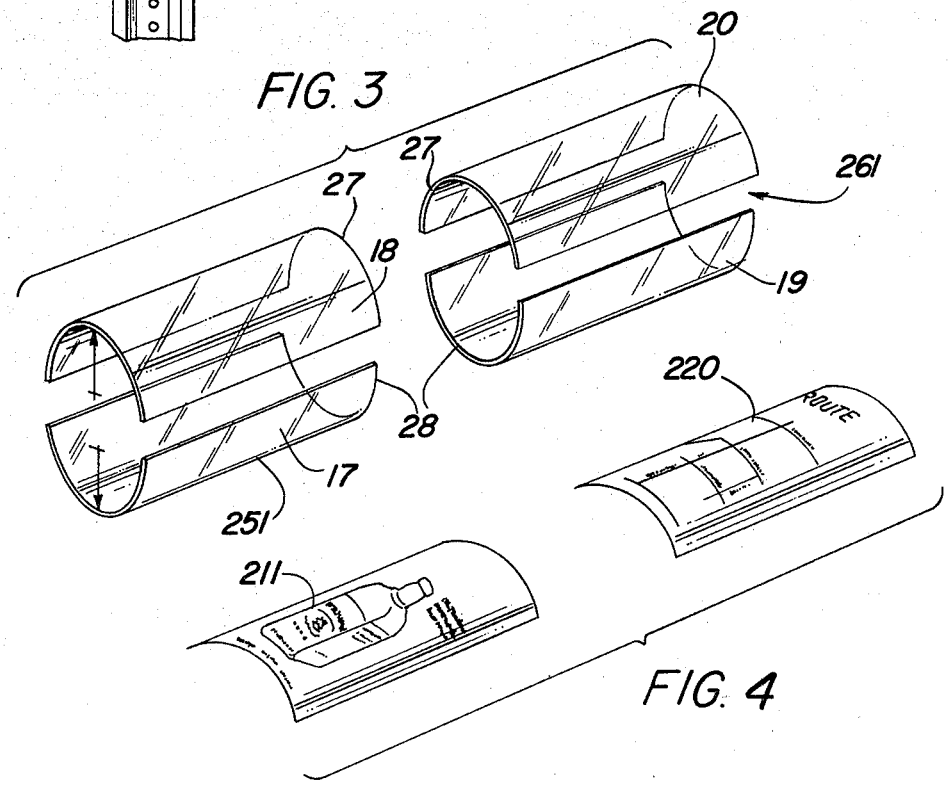
FIG. 4

TIMETABLE DISPLAY

BACKGROUND OF THE INVENTION

The subject invention relates to display apparatus and particularly to a cylindrical display for presenting bus scheduling, advertising and the like.

Prior to the subject invention, a convenient, compact, inexpensive display for bus scheduling and related advertising at bus stops and other locations has been lacking. Timetables for bus routes have typically been available in large, flat, rectangular sheets which preclude convenient display and are subject to wear and tear from weather, vandalism and other hazards. With the increasing trend toward public transportation in many areas, the need for a functional display has been recognized by this inventor.

SUMMARY OF THE INVENTION

It is therefore an object of the invention to provide a display for timetables and associated advertising;

It is another object of the invention to provide such a display which is compact, durable and inexpensive;

It is a related object of the invention to provide such a display which permits display of a large amount of information in a relatively small area.

These and other objects and advantages are achieved by provision of a cylindrical display having inner and outer cylinders which sandwich sheets of advertising-bearing material. Retainer rings close the end of the cylinder to seal the cylinder and retain the advertising material. Easy attachment and accomodation of two adjacent sheets of advertising material within the inner and outer cylinders are also provided according to the invention.

BRIEF DESCRIPTION OF THE DRAWINGS

FIG. 1 illustrates the preferred embodiment of the invention installed on a standard at a bus stop.

FIG. 2 is a perspective of the outer half cylinders of the preferred embodiment.

FIG. 3 is a perspective of the two pairs of inner half cylinders used in the preferred embodiment.

FIG. 4 illustrates cardboard display segments as used in the preferred embodiment.

DETAILED DESCRIPTION OF THE PREFERRED EMBODIMENT

Figure 5:
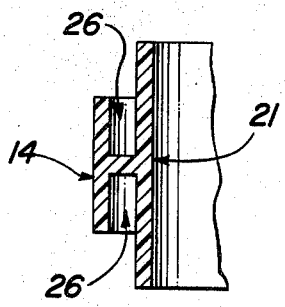
FIG. 5 is a cross-section of a rail retainer as used in the preferred embodiment.

FIG. 1 illustrates the preferred embodiment 11 mounted on a standard 13 to display bus scheduling and advertising information 14.

FIGS. 2–4 illustrate the components of the preferred embodiment 11. These include outer half cylinders 15, 16 (FIG. 2), two pairs 251, 261 of inner half cylinders 17, 18, 19, 20 and thin rectangular cardboard display segments 211, 221.

The outer half cylinders 15, 16, are of a clear, hard plastic material to permit display of information. The inner wall of outer cylinder 15 is fitted with plastic rails to provide sealing of the semi-cylindrical sections to form a complete cylinder. The rails 23, 24 may be attached by glue or other means to the semi-cylinder 15.

The inner pairs 251 and 261 of semi-cylinders 17, 18, 19, 20 are of a radius slightly smaller than that of the outer cylinder formed by semi-cylinders 15, 16 such that they may fit concentrically therein. A retainer ring (FIG. 5) is provided with slots 26 where the inner edges 27, 28 of the pairs 251, 261 fit. The length of the cylinders 251, 261 is such that when fitted into the retainer ring 21, the overall assembly of retainer ring 21 and cylinders 251, 261 is of the same length as the outer half cylinders 15, 16.

Figure 6:
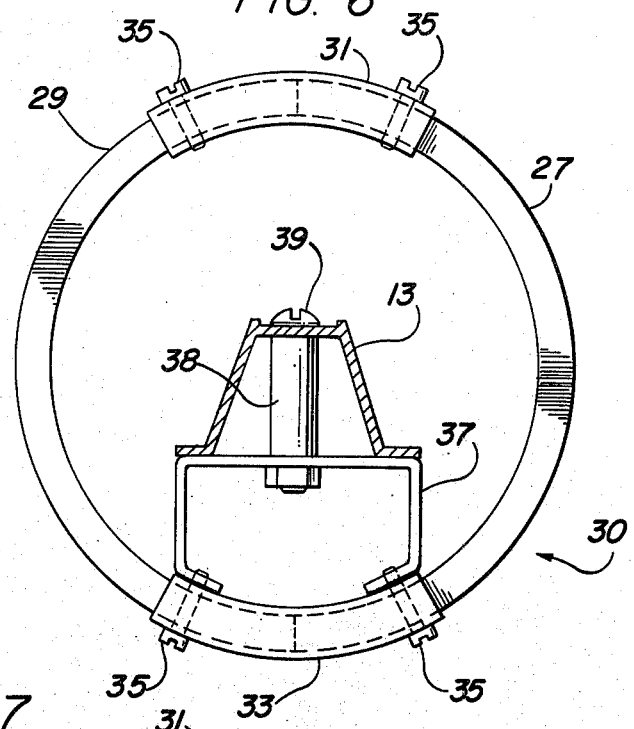
FIG. 6 is a top view of one of the metal retainer rings used in the preferred embodiment.
Figure 7:
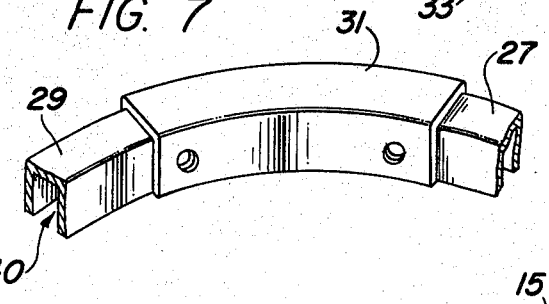
FIG. 7 is a perspective view of a portion of the retainer ring of FIG. 5.

The cardboard display segments 211, 221 are held in place by the inner and outer cylinder assemblies and by their abutment within respective slots 26 of the retainer ring 21. The front 41 of the retainer ring 21 abuts the clear plastic cylinder sections 15, 16. These assemblies are closed and held in place at top and bottom by upper and lower retainer rings 30 (FIGS. 6 and 7). In assembly, the concentric cylinders are pressed tightly together and fitted into a channel 40 in the retainer ring 30. A substantially watertight seal is thus effected.

Figure 8:
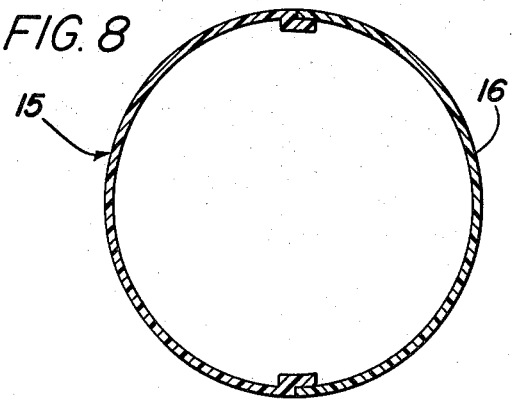
FIG. 8 is a cross-section of an alternate method for sealing the outer half cylinders of the preferred embodiment.
Figure 9:
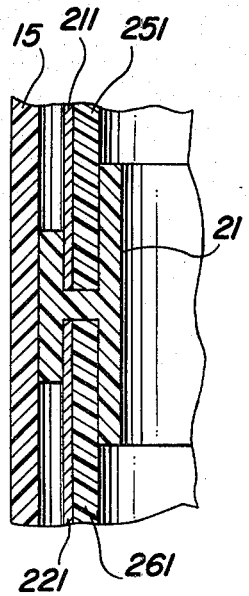
FIG. 9 shows a cross-section of the retainer ring of the preferred embodiment with cylindrical sections in place.

As illustrated in FIG. 8, one of the inner and outer semi-cylindrical sections 15, 16 may alternatively be contoured slightly at its edges so that the corresponding section 16 overlaps and seals with the contoured edge. This sealing is effected when the cylinders formed by sections 15, 16, 251, 261 are securely fastened within the retainer ring 30.

FIG. 6 and FIG. 7 show the metal retainer ring 30 in more detail. The ring 30 includes respective half sections 27, 29 of U-shaped cross-section. The half sections 27, 29 are secured in position by complementary overlapping U-shaped brackets 31, 33. Bolts, rivets or other fastening means 35 are inserted through the brackets 31, 33; the retainer rings 27, 29; and the cylindrical sections to attach the two retainer rings 27, 29 together and hold the overlapping U-shaped members 31, 33 and cylindrical sections in place.

Two of the fastening means 35 also pass through and attach a bracket 37. A shaft 38 is attached to the bracket 37 as an integral part thereof or, alternatively, by a bolt or other fastening means. A screw 39 threadably inserted into the shaft 38 attaches the bracket 37 and display 11 onto the standard 13.

The foregoing preferred embodiment is subject to adaptation and modifications which will occur to those skilled in the art enabled by this disclosure. Therefore, it is to be understood that, within the scope of the appended claims, the invention may be practiced other than as specifically described.

What is claimed is:

1. A display apparatus comprising:

first, second and third concentric layers, the first layer being substantially transparent, the second layer bearing information;

said first layer including first and second half cylinders;

said third layer including first and second pairs of half cylinders;

said second layer including first and second display segments;

a retainer ring means having a slot therein for receiving said first and second pairs of half cylinders and said first and second display segments;

first retainer means having a cylindrical, substantially U-shaped channel therein for enclosing said first, second, and third, concentric layers at one end thereof;

second retainer means having a cylindrical, substantially U-shaped channel therein for enclosing said first, second, and third, concentric layers at the opposite end thereof;

means for fastening said first and second retainer means to said first, second, and third concentric layers;

2. The apparatus of claim 1 further including:

Bracket means for attaching the assembly formed by application of said fastening means to a standard.

3. A display apparatus comprising:

first, second and third concentric layers, the first layer being substantially transparent, the second layer bearing information;

said first layer including first and second half cylinders;

said third layer including first and second pairs of half cylinders;

said second layer including first and second display segments;

means at the linear edge of said first half cylinder for providing a contoured overlapping seal with said second half cylinder upon fastening said first and second half cylinders into position;

a retainer ring means having a slot therein for receiving said first and second pairs of half cylinders and said first and second display segments, said retainer ring means being attached to the inner face of said first concentric layer and substantially near the midpoint thereof;

first retainer means having a cylindrical, substantially U-shaped channel therein for enclosing said first, second and third concentric layers at one end thereof;

second retainer means having a cylindrical, substantially U-shaped channel therein for enclosing said first, second and third concentric layers at the opposite end thereof; and means for fastening said first and second retainer means to said first, second and third concentric layers, thereby press-fitting a substantially watertight seal between said first and second half cylinders and about said display segments.

4. The apparatus of claim 3 wherein said means at the linear edge of said first half cylinder comprises a rail attached thereto.

* * * * *